US005414175A

United States Patent [19]

Cook

[11] Patent Number: 5,414,175

[45] Date of Patent: May 9, 1995

[54] INCREASED PRODUCTION OF ALKYLNAPHTHALENES FROM REFORMING

[75] Inventor: Bruce R. Cook, Baton Rouge, La.

[73] Assignee: Exxon Research and Engineering Company, Florham Park, N.J.

[21] Appl. No.: 134,359

[22] Filed: Oct. 8, 1993

[51] Int. Cl.[6] ..... C10G 35/085; C10G 35/095; C07C 2/66

[52] U.S. Cl. ..... 585/467; 585/404; 208/60; 208/138; 208/141

[58] Field of Search ..... 585/404, 470, 471, 474, 585/475, 476, 486, 481, 480, 467; 208/60, 138, 141

[56] References Cited

U.S. PATENT DOCUMENTS 3,855,328 12/1974 Hedge ..... 585/471

*Primary Examiner*—Asok Pal
*Assistant Examiner*—Bekir L. Yildirim
*Attorney, Agent, or Firm*—Henry E. Naylor

[57] ABSTRACT

A method for producing alkylnaphthalenes in a reformer process unit used to reform a gasoline boiling range hydrocarbonaceous feedstock in the presence of a platinum containing supported catalyst at reforming process conditions, the method comprising spiking said feedstock with up to about 5 vol.% of an additional stream containing a substantial amount of tetralins and decalins, based on the volume of feedstock.

5 Claims, No Drawings

INCREASED PRODUCTION OF ALKYLNAPHTHALENES FROM REFORMING

FIELD OF THE INVENTION

The present invention relates to the production of alkylnaphthalenes by spiking a feedstock to a reformer process unit with a stream containing a substantial amount of tetralins and decalins.

BACKGROUND OF THE INVENTION

There is an increased demand for heavy aromatic solvents containing a substantial amount of alkylnaphthalenes. Such solvents are typically used for such things as reclaiming rubber, as cleaning agents, as carriers for oil field chemicals, as carriers for industrial chemicals, and in pesticides. Non-limiting examples of such solvents are those designated as aromatic 100 solvent (A-100), aromatic 150 solvent (A-150), and aromatic 200 solvent (A-200). A-200, which generally contains from about 75 to 95 wt. % alkylnaphthalenes, is in particularly high demand. The market for such solvents is very lucrative because demand for such heavy solvents currently exceeds production. These aromatic solvents are conventionally produced by various techniques.

One such technique is found in British Patent No. 977,642 to British Petroleum which teaches a process for producing aromatic solvents by fractionating a reformate cut boiling in the range of 145° C. to 200° C., then treating this cut with sulfuric acid. Also, U.S. Pat. No. 3,398,083 discloses the production of aromatic hydrocarbons by solvent extraction. The resultant aromatics can then be fractionated into benzene, toluene, individual $C_8$ isomer streams, and a $C_9$+aromatics stream. Further, U.S. Pat. No. 3,324,029 teaches a process for producing a heavy aromatic solvent by steam cracking a gas oil to produce a heavy tar, which is then heat soaked and flashed and a 175° C. to 290° C. boiling fraction is recovered.

While one of the most commonly used methods today for producing heavy aromatic solvents is the distillation of reformer bottoms, most refineries do not have distillation facilities associated with reformer units. While additional distillation facilities can be built to produce such solvents from reformer bottoms, the capital investment would be substantial.

Therefore, there exits a need in the art for methods of increasing the production of these heavy aromatic solvents in existing equipment without the need for substantial capital investment.

SUMMARY OF THE INVENTION

In accordance with the present invention, there is provided a method for increasing the production of alkylnaphthalenes in a reformer process unit used to reform a gasoline boiling range hydrocarbonaceous feedstock in the presence of a platinum containing supported catalyst at reforming process conditions. The method comprises adding, to said feedstock, up to about 5 vol. % of a stream containing a substantial amount of tetralins and decalins, based on the volume of feedstock.

In a preferred embodiment of the present invention, the stream contains at least about 70 vol. % of tetralins and decalins, based on the volume of hydrocarbonaceous feedstock.

In another preferred embodiment of the present invention, the stream is a hydrocrackate stream boiling between about 160° C. and 260° C.

DETAILED DESCRIPTION OF THE INVENTION

Catalytic reforming is a well established refinery process for improving the octane quality of hydrocarbonaceous streams such as naphthas or straight run gasoline boiling range feedstocks. Nonlimiting examples of such feedstocks include the light hydrocarbon oils boiling from about 20° C. to 260° C., preferably from about 80° C. to 210° C., for example straight run naphthas, synthetically produced naphthas such as coal and oil-shale derived naphthas, thermally or catalytically cracked naphthas, hydrocracked naphthas, or blends or fractions thereof.

Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends the reactor in an annular bed and is passed to a regeneration zone and after regeneration it is recycled to the moving-bed reactor. Both the reactor and the regenerator are operated in a continuous moving-bed mode.

In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Typical catalysts used in catalytic reforming include both monofunctional and bifunctional, monometallic and multimetallic noble metal-containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of substantially spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250m2/g. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

It is also within the scope of the present invention that the catalyst used in the fixed-bed reforming zones may include crystalline aluminosilicates, such as zeolites. Non-limiting examples of zeolites which may be used herein include those having an effective pore diameter, particularly L-zeolites, zeolite X, and zeolite Y. Preferred are the L-type zeolites, which can be defined as synthetic zeolites which crystallize in the hexagonal system with a characteristic X-ray diffraction pattern obtained from CuKu$\alpha$ radiation, and values as set forth in column 8 of U.S. Pat. No. 4,975,178, which is incorporated herein by reference.

Typical reforming operating conditions for reactors of a fixed-bed reforming process unit include temperatures from about 425° C. to about 650° C.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5$+feed, preferably 1.5 to 5 moles of hydrogen per mole of C5+feed.

Moving-bed reforming is well known in the art and is taught in U.S. Pat. Nos. 3,652,231; 3,856,662; 4,167,473; and 3,992,465 which are all incorporated herein by reference. The general principle of operation of moving-bed reforming is that the catalyst is contained in an annular bed formed by spaced cylindrical screens within a reactor. The reactant stream is processed through the catalyst bed, typically in an out-to-in radial flow, that is, it enters the reactor at the top and flows radially from the reactor wall through the annular bed of catalyst which is descending through the reactor, and passes into the cylindrical space created by said annular bed. It exits the bottom of the reforming zone and is passed to separation or collection facilities. Spent catalyst is sent to a regeneration zone from which it is recycled to the reactor. The reforming catalyst charged to a moving-bed reforming process unit is typically comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the bulk density of this solid being from about 0.5 to 0.9 and more particularly from about 0.5 to 0.8.

Heavy aromatic solvent streams, comprised of a substantial amount of alkylnaphthalenes, preferably $C_{10}$–$C_{12}$ are produced in accordance with the present invention in a reforming unit by spiking, or replacing, up to about 5 vol. % of the Conventional naphtha stream with a stream comprised of a substantial amount of tetralins and decalins. The alkylnaphthalenes will typically contain from about 10 to 14 carbons, preferably from about 10 to 12 carbon atoms. It is preferred that the stream contain at least about 50 wt. %, more preferably at least about 60 wt. %, and most preferably at least about 75 wt. % tetralins and decalins. It is also preferred that the stream be a petroleum refining stream. Non-limiting examples of such streams include hydrocrackate streams, preferably the 160° C. to 275° C. cut, more preferably the 160° C. to 260° C. cut, stream off of the hydrocrackate; and a 175° C. to 275° C. cut, preferably the 190° C. to 260° C. cut from a pipestill. A hydrocrackate stream is preferred because it typically contains a significant amount of tetralins and decalins.

The amount of said spiking stream which will be used will generally range from about 0.5 to 5 vol. %, preferably from about 1 to 5 vol. %, and more preferably from about 2 to 4 vol. %. The precise amount of said spiking stream which will be used will of course depend on such things as the desired amount of alkylnaphthalenes versus the loss of gasoline product produced in the reforming unit.

The present invention will be more fully understood and appreciated by reference to the following examples based on computer model predictions and are presented for illustrative purposes and which are not intended to define the scope of the invention.

Example 1 (Comparative)

A 3/8" ID stainless steel microreactor was charged with 1.7 g of a sulfided commercial Pt-Re on alumina reforming catalyst, and approximately 10 g. of 14/35 mesh mullite as an inert. The commercial Pt-Re catalyst has a designation KX-120 and is available from AkZO Chemicals International. KX-120 has a Pt content of 0.3 wt. %, a Re content of 0.3 wt. %, a surface area of 180 to 200 $m^2/g$, a pore volume of 0.45 to 0.55 cc/g. The reactor was subsequently pressurized to 140 psig with hydrogen and the temperature raised to 520° C. Heptane, as a model reformer feed, and hydrogen were both fed into the reactor at flows of 17 cc/hour and 150 cc/min respectively. Liquid products were collected at −4° C., using a glycol cooled product accumulator and analyzed using standard gas chromatography and mass spectrophotometry techniques. The yields and selectivities of desired alkylnaphthalene products are shown in Table I below. The yield of alkylnaphthalenes from n-heptane are clearly very small (only 0.6 wt. %).

TABLE I

| Wt. % | Selectivities | | | |
|---|---|---|---|---|
| Naphth. | Naphth. | (Me)Naphth. | $(Me)_2$Naphth. | $(Me)_3$Naphth. |
| 0.6 | 13.3 | 27.3 | 26.6 | 32.9 |

Wt % Naphth. indicates the total weight percent yield of alkylnaphthalene based on total weight heptane feed. Selectivities represent the relative percent of each type naphthalene of all the naphthalene derived products.

Example 2 (Comparative)

A feed composed of 5 wt % tetradecane ($C_{14}H_{30}$) and 95 wt. % heptane was subjected to the same catalytic conditions described in Example 1. The yield and selectivities of desired naphthalene products are shown in Table II below. The yield of naphthalenes clearly go up relative to the simple heptane feed in Example 1, but the total yield (0.8 wt. %) and the yield based on just the tetradecane (4 wt. %) indicate that the addition of long straight chain hydrocarbons do not appreciably increase the yield of alkylnaphthalenes.

TABLE II

| | Wt. % | Selectivities: | | | |
|---|---|---|---|---|---|
| Wt. % Naphth. | Yield (Spike) | Naphth. | (Me) Naphth. | $(Me)_2$ Naphth. | $(Me)_3$ Naphth. |
| 0.8 | 4 | 12.2 | 30.9 | 31.9 | 25.0 |

Wt.% Yield (Spike) is the percent yield (based only on the tetradecane in the feed) of additional alkylnaphthalenes formed by adding 5 wt. % tetradecane to the feed. Selectivities represent relative percent of each type naphthalene of all the naphthalene derived products.

Example 3

A feed composed of 5 wt. % methyldecahydronaphthalene and 95 wt. % heptane was subjected to the same catalytic conditions described in Example 1. The yield and selectivities of desired naphthalene products are shown in Table III below. A very large increase in both the total yield (4.2 wt. %) and the yield based on only the methyldecahydronaphthalene in the feed (72 wt. %). This clearly demonstrates that two ring naphthenes are preferred over long paraffins (ie tetradecane) as naphthalene precursors.

TABLE III

| | Wt. % | Selectivities: | | | |
|---|---|---|---|---|---|
| Wt. % Naphth. | Yield (Spike) | Naphth. | (Me) Naphth. | $(Me)_2$ Naphth. | $(Me)_3$ Naphth. |
| 4.2 | 72 | 11.3 | 80.2 | 3.2 | 5.3 |

Wt.% Yield (Spike) is the percent yield (based only on the methyldecahydronaphthalene in the feed) of additional alkylnaphthalenes formed by adding 5 wt. % decahydronaphthalene to the feed. Selectivities represent relative percent of each type naphthalene of all the naphthalene derived products.

Example 4

A feed composed of 5 wt. % light hydrocracker distillate and 95 wt. % heptane was subjected to the same catalytic conditions described in Example 1. The light hydrocracker distillate used was a 160–220° C. boiling cut derived from a commercial 1500 psig hydrocracker. Mass spectroscopy indicate that it contains approximately 40–50 wt. % of desirable fused two ring naphthenes and naphthenoaromatic molecules. This feed contains essentially no sulfur and nitrogen contaminants. The yield and selectivities of desirable naphthalene products are shown in Table IV below. Significantly increased yields of naphthalene products are observed based on both total feed (1.8 wt. %) and the hydrocracker distillate (20 wt. %). The approximate yield based on the amount of fused two ring naphthene and naphthenoaromatic precursors is significantly higher at 40–50 %. This boiling point range cut of hydrocracker distillate succeeds in demonstrating this invention, but is not meant to establish a preferred boiling range. A preferred boiling range for the hydrocracker distillate would be a 190°–260° C. range, because the lightest desirable fused two 6-member ring naphthene possible, decalin, boils at 190° C.

TABLE IV

| | Wt. % | Selectivities: | | | |
|---|---|---|---|---|---|
| Wt. % Naphth. | Yield (Spike) | Naphth. | (Me) Naphth. | $(Me)_2$ Naphth. | $(Me)_3$ Naphth. |
| 1.8 | 20 | 23.0 | 49.3 | 27.7 | — |

Example 5

A feed composed of 5 wt. % hydrotreated catalytic cracked distillate and 95 wt. % heptane was subjected to the same catalytic conditions described in Example 1. The hydrotreated catalytic cracked distillate was a 220° C. to 290° C. cut from a commercial fluid catalytic cracking unit that was hydrotreated over a commercially available catalyst sold under the trade name TN-8 by Akzo Catalyst Company. TN-8 is a NiCoMo on alumina hydrotreating catalyst having the following properties: apparent bulk density 590 $kg/m^3$; surface area 285 $m^2/g$; with the shape being quadralobe, at 340° C., 650 psig $H_2$, 2000 SCF/B (Standard Cubic Feet per Barrel) treat rate of hydrogen, and LHSV (Liquid Hourly Space Velocity) of 1.5. The hydrotreated product used in these experiments contained less than 5 ppm sulfur and was composed of 70–75 wt. % fused two ring naphthenes and naphthenoaroamatics. The yield and selectivities of desirable naphthalene products are shown in Table V below.

TABLE V

| Wt. % Naphth. | Wt. % Yield (Spike) | Selectivities: Naphth. | (Me) Naphth. | $(Me)_2$ Naphth. | $(Me)_3$ Naphth. |
|---|---|---|---|---|---|
| 4.8 | 84 | 5.3 | 23.9 | 43.9 | 27.0 |

The product yields clearly demonstrate that feeds containing large amounts of fused two ring naphthenes are preferred for increasing alkylnaphthalene production.

What is claimed is:

1. A method for increasing the production of alkylnaphthalenes in a reformer process unit, which method comprises: (i) reforming a gasoline boiling range hydrocarbonaceous feedstream in the presence of a platinum containing supported catalyst at reforming conditions including temperatures from about 425° C. to about 650° C. and pressures from about 100 psig to about 500 psig; and (ii) introducing up t about 5 vol. % of an additional stream, based on the volume of the feedstream, which additional stream contains at least about 20 wt. % of tetralins and decalins.

2. The method of claim 1 wherein the additional stream is 160° C. to 275° C. boiling range fraction from a hydrocrackate.

3. The method of claim 2 wherein the additional stream is a 160° C. to 260° C. boiling range fraction from a hydrocrackate.

4. The method of claim 2 wherein the additional stream is a 175° C. to 275° C. boiling range fraction from a pipestill in a petroleum refinery.

5. The method of claim 1 wherein the reformer process unit is selected from semi-cyclic, cyclic, and continuous catalyst regeneration units.

* * * * *